US008133665B2

(12) United States Patent
Hosoya et al.

(10) Patent No.: US 8,133,665 B2
(45) Date of Patent: Mar. 13, 2012

(54) SILVER HALIDE PHOTOSENSITIVE MATERIAL AND PROCESS OF PRODUCING BLACK AND WHITE IMAGE USING THE SAME

(75) Inventors: Yoichi Hosoya, Kanagawa (JP); Naoharu Kiyoto, Kanagawa (JP); Junichiro Hosokawa, Kanagawa (JP); Masaaki Miki, Kanagawa (JP); Kouichi Yokota, Kanagawa (JP); Ryoji Nishimura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 12/562,149

(22) Filed: Sep. 18, 2009

(65) Prior Publication Data

US 2011/0070548 A1 Mar. 24, 2011

(51) Int. Cl.

| | |
|---|---|
| ***G03C 7/00*** | (2006.01) |
| ***G03C 7/46*** | (2006.01) |
| ***G03C 1/005*** | (2006.01) |
| ***G03C 3/00*** | (2006.01) |
| ***G03C 1/494*** | (2006.01) |

(52) U.S. Cl. ..... 430/567; 430/495.1; 430/564; 430/357; 430/374; 430/505

(58) Field of Classification Search ..... 430/564, 430/567, 495.1, 357, 374, 505
See application file for complete search history.

(56) References Cited

U.S. PATENT DOCUMENTS

| | | | | |
|---|---|---|---|---|
| 5,283,164 | A | 2/1994 | Fenton et al. | |
| 7,115,357 | B2 * | 10/2006 | Haraguchi et al. | 430/505 |
| 7,368,230 | B2 | 5/2008 | Hosokawa et al. | |

OTHER PUBLICATIONS

Fujifilm Research & Development vol. 53, pp. 1-7 (2008).

* cited by examiner

*Primary Examiner* — Geraldina Visconti
(74) *Attorney, Agent, or Firm* — Solaris Intellectual Property Group, PLLC

(57) ABSTRACT

Disclosed is a silver halide photographic photosensitive material which includes a support and at least one silver halide photosensitive layer on the support, wherein the average equivalent sphere diameter of the silver halide of the silver halide photosensitive layer is 0.30 μm or less, the silver halide photosensitive layer includes four or more kinds of silver halide grains having mutually different average equivalent sphere diameters, and the thickness between a surface of the support at a side at which the silver halide photosensitive layer is provided and a surface of the silver halide photosensitive layer at a side opposite to the support is 10 μm or less.

19 Claims, No Drawings

SILVER HALIDE PHOTOSENSITIVE MATERIAL AND PROCESS OF PRODUCING BLACK AND WHITE IMAGE USING THE SAME

BACKGROUND OF THE INVENTION

1. Field of the Invention

The present invention relates to a silver halide photographic photosensitive material and a method of forming a black-and-white image using the same.

2. Description of the Related Art

In recent movie production, even for movies shot on movie films, a method in which movie film images (master images) are digitized to be synthesized and edited, and outputted again as analogue images onto a silver halide color photographic photosensitive material using a film recorder, is widely used. Many proposals have been made for silver halide color photographic photosensitive materials (color intermediate films) for use with output by a film recorder, including those described in U.S. Pat. Nos. 7,368,230 and 5,283,164, and *FUJIFILM RESEARCH & DEVELOPMENT* Vol. 53, pp. 1-7 (2008).

In the movie production, although digital archives, which store digital data taken unchanged from the master, may be an effective archiving method, they fail to serve as a final archiving method due to uncertainty surrounding the format and stability of digital data storage media. From the viewpoint of preservation of cultural property in particular, the highest reliability is obtained by printing an image corresponding to once-digitalized data on a black-and-white silver halide photosensitive material (also called "silver halide film"), subjecting the black-and-white silver halide photosensitive material to development and fixing treatment so as to form a black silver image, and storing the resultant together with the digital data, and this procedure is recommended.

The archiving of such digital data on the silver halide film generally employs the film recorder used in the movie production process. Black-and-white silver halide photographic photosensitive materials are used for the archiving of the digital data by the film recorder.

When the above method is used with a conventional technique, image quality is deteriorated when the digital data is outputted onto the silver halide photographic photosensitive material at high resolution, which has not always been satisfactory from the viewpoint of obtaining sufficient quality corresponding to the capabilities of digital recorders, the performance of which has been remarkably improving. The deterioration of the image quality has been found to be greatly influenced by the development treatment of the black-and-white silver halide photographic photosensitive material.

The output from the film recorder is controlled to be optimum for the characteristics (characteristic curve) of the silver halide photographic photosensitive material on which the output is to be printed. When aiming for the reproduction of high-resolution digital images, it is necessary to suppress variations caused in the development treatment of the silver halide photographic photosensitive material as far as possible, and maintain the characteristics as of the time of calibration as far as possible. In particular, a large change in gradation on the characteristic curve may cause deterioration of the output image formed by the film recorder.

Now that most movies are in color, it has been getting more difficult to maintain the quality of black-and-white development processing liquid in photofinishing laboratories at which movie films are processed. Further, preparing black-and-white development processing systems of respective kinds is also difficult from the viewpoint of productivity. Silver halide photographic photosensitive materials which are less influenced by processing liquid quality, and which show favorable characteristics even when different black-and-white processing formulations are used, have therefore been strongly desired.

SUMMARY OF THE INVENTION

The present invention has been made in view of the foregoing problems, and aims at providing a silver halide photographic photosensitive material which is capable of recording digital information at high resolution without deterioration and of which variation in characteristics caused by difference in development treatment formulation is small, and an image forming method using the same.

According to an aspect of the present invention, a silver halide photographic photosensitive material is provided which includes a support and at least one silver halide photosensitive layer on the support, wherein the average equivalent sphere diameter of the silver halide of the silver halide photosensitive layer is 0.30 μm or less, the silver halide photosensitive layer includes four or more kinds of silver halide grains having mutually different average equivalent sphere diameters, and the thickness between a surface of the support at a side provided with the silver halide photosensitive layer and a surface of the silver halide photographic photosensitive material is 10 μm or less.

According to another aspect of the present invention, a silver halide photographic photosensitive material is provided which includes a support and at least one silver halide photosensitive layer on the support, wherein γ(D97), which is the contrast on a characteristic curve obtained as a result of three-minute development with D97 developer, fulfills the condition defined by the following Formula (1), and γ(D96), which is the contrast on a characteristic curve obtained as a result of eight-minute development with D96 developer, fulfills the condition defined by the following Formula (2):

$$0.6 \leqq \gamma(D97) \leqq 1.6 \quad (1)$$

$$0.6 \leqq \gamma(D96) \leqq 1.6 \quad (2)$$

According to another aspect of the present invention, a silver halide photographic photosensitive material is provided in which γ(D97) described above fulfills the condition defined by Formula (1) and γ(D96) described above fulfills the condition defined by Formula (2), and the ratio between γ(D97) and γ(D96) fulfills the following Formula (3):

$$0.8 \leqq \gamma(D97)/\gamma(D96) \leqq 1.39 \quad (3)$$

According to another aspect of the present invention, a method of forming a black-and-white image including subjecting the above silver halide photosensitive material to imagewise exposure and development is provided.

DETAILED DESCRIPTION OF THE INVENTION

In the silver halide photosensitive material of the present invention, the silver halide of the silver halide photosensitive layer has an average equivalent sphere diameter of 0.30 μm or less, and the silver halide photosensitive layer includes four or more kinds of silver halide grains that mutually differ in grain size. On the characteristic curve obtained by developing the silver halide photosensitive material with D97 developer or D96 developer used for black-and-white development, each of γ(D97) and γ(D96) is nearly equal to 1, thus providing a particularly preferable gradation as a silver halide film used for movie archives.

With the silver halide photographic photosensitive material of the present invention, variation of the characteristic curve caused by variation of the development processing condition (hereinafter referred to as "development dependency") is small and, for example, the difference between the above-mentioned γ(D97) and γ(D96) is small. Therefore, it is not necessary to prepare various types of black-and-white development processing systems, which is preferable from the viewpoint of productivity.

Heretofore, EK2238 (registered trademark), which is a black-and-white silver halide photosensitive material sold by Eastman Kodak Company, has been widely used for movie archives. EK2238 (registered trademark) contains one kind of silver halide grains having a broad grain size distribution in a silver halide photosensitive layer. Thus, either γ(D97) or γ(D96) is far from 1, and the difference between γ(D97) and γ(D96) is large, which is not preferable from the viewpoint of productivity.

As described above, the silver halide photosensitive material of the invention produces significantly advantageous effects as compared to silver halide photosensitive materials that have been used for conventional movie archives.

Further, the silver halide photosensitive material of the invention allows recording of digital data at high resolution using a film recorder, and deterioration of image quality is suppressed.

Moreover, γ(D97) or γ(D96) is almost equal to 1, and thus a gradation that is particularly preferable for movie archives is obtained. This configuration also reduces development dependency, and, for example, the difference between γ(D97) and γ(D96) can be further decreased.

In the following, the silver halide photosensitive material of the present invention is described in detail.

[Silver Halide Photosensitive Layer]

The silver halide photosensitive layer used in the silver halide photographic photosensitive material of the invention usually employs a so-called silver halide emulsion in which silver halide grains are dispersed in a hydrophilic binder such as gelatin. In the present invention, the average equivalent sphere diameter of the silver halide grains in the silver halide photosensitive layer is 0.30 μm or less.

The average equivalent sphere diameter of silver halide grains is an average value of the diameters of the silver halide grains if the silver halide grains are spherical, or an average value of the diameters of circle images respectively having the same areas as the projections of the silver halide grains if the silver halide grains are cubic or in other shapes than spheres, or an average value of the diameters of the equivalent volume spheres respectively having the same volumes as those of the silver halide grains if the silver halide grains are tabular. The shapes and the projections of the silver halide grains can be observed under a microscope or an electron microscope.

In the present invention, the average equivalent sphere diameter of the silver halide grains of the silver halide photosensitive layer is preferably 0.25 μm or less, more preferably 0.20 μm or less, and still more preferably 0.19 μm or less.

In the present invention, the silver halide photosensitive layer includes four or more kinds of silver halide grains having mutually different average equivalent sphere diameters. The four kinds of silver halide grains are each preferably monodispersed. Of the four kinds of monodispersed silver halide grains, it is preferred that the average equivalent sphere diameter D1 of the monodispersed silver halide grains having the smallest average equivalent sphere diameter is selected from the range, 0.05 μm≦D1≦0.10 μm, and that the average equivalent sphere diameter D2 of the monodispersed silver halide grains having the greatest average equivalent sphere diameter is selected from the range, 0.15 μm≦D2≦0.30 μm.

It is more preferred that D1 is selected from the range, 0.05 μm≦D1≦0.10 μm, and that D2 is selected from the range, 0.15 μm≦D2≦0.25 μm. It is most preferred that D1 is selected from the range, 0.06 μm≦D1≦0.8 μm, and that D2 is selected from the range, 0.17 μm≦D2≦0.20 μm.

Regarding the average equivalent sphere diameters D3 and D4 of the two monodispersed silver halide grains having average equivalent sphere diameters between D1 and D2, D3 is selected from the range, 0.07 μm≦D3≦0.12 μm, and D4 is selected from the range, 0.09 μm≦D4≦0.17 μm. It is more preferred that D3 is selected from the range, 0.07 μm≦D3≦0.11 μm, and that D4 is selected from the range, 0.09 μm≦D4≦0.15 μm. It is most preferred that D3 is selected from the range, 0.8 μm≦D3≦0.10 μm, and that D4 is selected from the range, 0.10 μm≦D4≦0.14 μm. In any case, the combination of D1 to D4 should be selected to satisfy D1<D3<D4<D2.

In the present invention, the silver halide or silver halides of the four types of monodispersed silver halide grains having different average equivalent sphere diameters for use in the silver halide photosensitive layer are each preferably a silver iodobromide containing silver iodide at 2.5 mol % or less, a silver iodochloride containing silver iodide at 2.5 mol % or less, or a silver iodobromochloride containing silver iodide at 2.5 mol % or less. When the silver halide containing silver iodide within the above range is used, both of the contrast γ(D97) and the contrast γ(D96) are values at or close to 1, as a result of which a gradation particularly preferable for movie archives is obtained. Further, this configuration reduces development dependency, and, for example, can further reduces the difference between γ(D97) and γ(D96). The content of silver iodide is more preferably 2.4 mol % or less, still more preferably 2.2 mol % or less, and most preferably 2.0 mol % or less.

The lower limit of the content of silver iodide is 0.5 mol %.

In the present invention, the silver halide photosensitive layer is preferably provided on a support such that the amount of silver of the silver halide grains is in the range of from 1.0 $g/m^2$ to 3.5 $g/m^2$. When the silver halide photosensitive material has two or more silver halide photosensitive layers, the above range of the silver amount means the range of the total silver amount of the silver halide grains contained in all silver halide photosensitive layers.

A more preferred range of the silver amount of the silver halide grains is from 1.0 $g/m^2$ to 2.0 $g/m^2$, and the most preferred range thereof is from 1.5 $g/m^2$ to 2.0 $g/m^2$.

The monodispersed silver halide grains used in the present invention may have a regular crystal such as cube, octahedron, or tetradecahedron, or an irregular crystal shape such as a spherical or tabular shape, or a crystal having a crystal defect such as a twin plane, or a composite thereof. Those having cubic crystal shapes are preferred in the present invention.

The silver halide emulsion to be used in the present invention can be prepared using methods described in, for example, *Research Disclosure* (hereinafter abbreviated as RD) No. 17643 (December 1978), pp. 22 to 23, I. Emulsion preparation and types; ibid. No. 18716 (November 1979), p. 648; ibid. No. 307105 (November 1989), pp. 863 to 865; P. Glafkides, *Chimie et Phisique Photographiques*, (Paul Montel, 1967); G. F. Duffin, *Photographic Emulsion Chemistry* (Focal Press, 1966); and V. L. Zelikman, et al., *Making and Coating Photographic Emulsion* (Focal Press), 164.

Specifically, the silver halide emulsion containing monodispersed silver halide grains for use in the present invention can be prepared by already-known methods, such as a method of allowing a silver halide solvent to be present when preparing silver halide grains by reacting an aqueous solution of a water-soluble halide such as alkali metal halide and an aqueous solution of a water-soluble silver salt such as silver nitrate in an aqueous solution of a hydrophilic binder while regulating at least one of, preferably both of, the pAg and pH of the reaction liquid to be within a certain numerical range as necessary.

Examples of the silver halide solvent include (a) organic thioethers described in, for example, U.S. Pat. Nos. 3,271,157, 3,531,289, and 3,574,628 and Japanese Patent Application Laid-Open (JP-A) Nos. 54-1019 and 54-158917, (b) thiourea derivatives described in, for example, JP-A Nos. 53-82408 and 55-77737, (c) silver halide solvents having a thiocarbonyl group sandwiched between an oxygen or sulfur atom and a nitrogen atom described in, for example, JP-A No. 53-144319, (d) imidazoles described in, for example, JP-A No. 54-100717, (e) ammonia, and (f) thiocyanate.

Examples of particularly preferred solvents include thiocyanate, ammonia, and tetramethylthiourea.

The amount of the solvent to be used varies depending on the type thereof. When the solvent is thiocyanate, a preferred amount thereof is from $1\times10^{-4}$ mol to $1\times10^{-2}$ mol per 1 mol of silver halide.

Depending on the purpose, it may be preferable to allow a salt of a metal ion to be present when preparing the emulsion of the present invention, for example, at the time of grain formation, in the desalting step, at the time of chemical sensitization, and/or before coating.

The addition is preferably performed at the time of grain formation when the salt of a metal ion is doped to the grains, and the addition is preferably performed after grain formation but before the completion of chemical sensitization when the salt of a metal ion is used to modify the grain surface or is used as a chemical sensitizer.

As described above, a method may be selected in which doping to the entire grain, doping to a core portion of the grain only, doping to a shell portion of the grain only, or doping to an epitaxial portion of the grain only is performed.

For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and/or Bi may be used.

These metals can be added in any salt form that can be dissolved when forming grains, such as in the form of ammonium salts, acetates, nitrates, sulfates, phosphates, hydroxides, six-coordinate complex salts, or four-coordinate complex salts. Examples thereof include $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_2IrCl_6$, $(NH_4)_3RhCl_6$, and $K_4Ru(CN)_6$.

The ligand of the coordination compound may be selected from halo, aquo, cyano, cyanate, thiocyanate, nitrosyl, thionitrisyl, oxo, or carbonyl. The metal compound may be used singly, or in combination of two kinds thereof, or in combination of three or more kinds thereof.

The metal compound is preferably added after the compound is dissolved in an appropriate solvent such as water, methanol, or acetone. In order to stabilize the solution, a method of adding an aqueous hydrogen halide solution (such as HCl, HBr) or an alkali halide (such as KCl, NaCl, KBr, NaBr) may be employed. Acid or alkali may be added as necessary.

The metal compound may be added into a reaction vessel before grain formation or some time during grain formation. The metal compound may be added to the water-soluble silver salt (such as $AgNO_3$) or to the aqueous alkali halide solution (such as NaCl, KBr, KI), in which case the metal compound can be added continuously during the formation of silver halide grains. It is also possible to prepare another solution separately from the water-soluble silver salt and the alkali halide, and add this solution continuously in an appropriate period during the grain formation. Combination of various addition methods is also preferable.

A method of adding a chalcogen compound in the course of emulsion preparation, such as the method described in U.S. Pat. No. 3,772,031 is effective in some cases.

Other than S, Se, and Te, cyanate, thiocyanate, selenocyanate, carbonate, phosphate, and/or acetate may be present.

Monodispersed silver halide emulsions described in the specifications of U.S. Pat. Nos. 3,574,628 and 3,655,394 and UK Patent No. 1,413,748 are also preferable.

The crystal structure may be uniform, or may have inner and outer portions that have mutually different halogen compositions, or may have a layered structure.

Silver halides having mutually different compositions may be conjugated by epitaxial junction. A compound other than silver halide, such as silver rhodanate or lead oxide, may also be conjugated.

The silver halide emulsion may be of surface-latent-image type which forms a latent image mainly on the surface, or of internal-latent-image type which forms a latent image in the interior of the grain, or of a type having a latent image at both the surface and the interior. The silver halide emulsion has to be a negative working silver halide emulsion.

The internal-latent-image type silver halide emulsion may be a core/shell internal-latent-image type emulsion as described in JP-A No. 63-264740, and a preparation method thereof is described in JP-A No. 59-133542. The thickness of the shell in the emulsion varies depending on the development processing and the like, and is preferably from 3 nm to 40 nm, particularly preferably from 5 nm to 20 nm.

The silver halide emulsion to be used in the present invention has preferably been reduction-sensitized. For the reduction sensitization, any of the following methods may be used: a method of adding a reduction sensitizer to silver halide; a method of growing or ripening silver halide grains in a low-pAg environment having a pAg of from 1 to 7, which is called silver ripening; and a method of growing or ripening silver halide grains in a high-pH environment having a pH of 8 to 11, which is called high-pH ripening. It is also possible to use two or more of these methods in combination.

In particular, the method of adding a reduction sensitizer is preferable in that it allows fine regulation of the reduction sensitization level.

Examples of the reduction sensitizer include stannous salts, ascorbic acid and derivatives thereof, hydroquinone and derivatives thereof, catechol and derivatives thereof, hydroxylamine and derivatives thereof, amines and polyamines, hydrazine and derivatives thereof, paraphenylenediamine and derivatives thereof, formamidine sulfinic acid (thiourea dioxide), silane compounds, and borane compounds.

For the reduction sensitization in the invention, a reduction sensitizer such as those described above may be selected and used, and two or more compounds may be used in combination.

Regarding the method for the reduction sensitization, the methods described in U.S. Pat. Nos. 2,518,698, 3,201,254, 3,411,917, 3,779,777, and 3,930,867 may be employed. Regarding the usage method of the reducing agent, the methods described in Japanese Patent Publication (JP-B) Nos. 57-33572 and 58-1410 and JP-A No. 57-179835 may be employed.

The silver halide grains of the present invention may be subjected to at least one selected from sulfur sensitization, selenium sensitization, tellurium sensitization, gold sensitization, palladium sensitization, noble metal sensitization, or reduction sensitization, in any step in the production process of the silver halide emulsion. Combination of two or more types of sensitization methods is preferred.

One of chemical sensitizations that can be preferably performed in the present invention is either chalcogen sensitization or noble metal sensitization or a combination of chalcogen sensitization and noble metal sensitization, which may be performed using activated gelatin as described in T. H. James, *The Theory of the Photographic Process*, 4th ed, (Macmillan, 1977) pp. 67-76, or may be performed at a pAg of 5 to 10, a pH of 5 to 8, and a temperature of 30 to 80° C. using sulfur, selenium, tellurium, gold, platinum, palladium, or iridium, or a combination of two or more of these sensitizers, as described in *Research Disclosure* vol. 120 (April 1974), 12008, *Research Disclosure* vol. 34 (June 1975), 13452, U.S. Pat. Nos. 2,642,361, 3,297,446, 3,772,031, 3,857,711, 3,901,714, 4,266,018, and 3,904,415 and UK patent No. 1,315,755.

In noble metal sensitization, a salt of a noble metal such as gold, platinum, palladium or iridium may be used, among which gold sensitization, palladium sensitization, and a combination of gold sensitization and palladium sensitization is particularly preferred.

In the sulfur sensitization, an unstable sulfur compound may be used, for which the unstable sulfur compounds as described in, for example, P. Grafkides, *Chemie et physique Photographique* 5th ed. (Paul Momtel co., 1987) and *Research Disclosure* vol. 307, issue 307105 may be used.

In the selenium sensitization, an unstable selenium compound may be used, for which the selenium compounds as described in, for example, JP-B Nos. 43-13489 and 44-15748 and JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579 may be used.

In the tellurium sensitization, an unstable tellurium compound may be used, for which the unstable tellurium compounds as described in, for example, JP-A Nos. 4-224595, 4-271341, 4-333043, 5-303157, 6-27573, 6-175258, 6-180478, 6-208186, 6-208184, 6-317867, and 7-140579 may be used.

Useful chemical sensitization aids include compounds that are known to suppress fogging in the course of chemical sensitization and increase sensitivity, such as azaindene, azapyridazine, and azapyrimidine. Examples of chemical sensitization aid modifiers are described in U.S. Pat. Nos. 2,131,038, 3,411,914, and 3,554,757, JP-A No. 58-126526, and pp. 138 to 143 of the above-mentioned Duffin, *Photographic Emulsion Chemistry*.

The chemical sensitization condition in the present invention is not particularly limited, and the pAg may be from 6 to 11, preferably from 7 to 10; the pH may be from 4 to 10, preferably from 5 to 8; temperature may be from 40° C. to 95° C., preferably from 45° C. to 85° C.

It is preferable to use an oxidizing agent for silver during the production process of the emulsion of the present invention. The oxidizing agent for silver refers to a compound that has a function of acting on metallic silver and converting it to silver ion. In particular, a compound that converts extremely minute silver grains, which are generated as a byproduct in the silver halide grain formation process and the chemical sensitization process, to silver ion is effective. The silver ion thus generated may form a silver salt that is scarcely soluble in water, such as silver halide, silver sulfide, or silver selenide, or a silver salt that easily dissolves in water, such as silver nitrate.

The oxidizing agent for silver may be either an inorganic substance or an organic substance.

Preferred oxidizing agents in the present invention are inorganic oxidizing agents including ozone, hydrogen peroxide and addition products thereof, halogen elements, and thiosulfonates, and organic oxidizing agents including quinones.

In a preferred embodiment, the reduction sensitization and the oxidizing agent for silver are employed in combination.

The method to be used may be selected from a method of performing reduction sensitization after the oxidizing agent is used, an inverted method thereof, or a method in which use of the oxidizing agent and reduction sensitization are simultaneously.

These methods may be employed in the grain formation process and/or the chemical sensitization process.

Various compounds may be included in the silver halide emulsion used in the present invention for the purpose of suppressing fogging during the production process of the photosensitive material, storage of the photosensitive material, or photographic processing of the photosensitive material, or for the purpose of stabilizing the photographic characteristics.

Many compounds that are known as antifoggants or stabilizers may be used, and examples thereof include thiazoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), mercaptopyrimidines, mercaptotriazines, thioketocompounds such as oxazolinethione, azaindenes such as triazaindenes, tetraazaindenes (particularly, 4-hydroxy-substituted (1,3,3a,7)tetraazaindenes), and pentaazaindenes. For example, those described in U.S. Pat. Nos. 3,954,474 and 3,982,947 and JP-B No. 52-28660 may be used.

Preferred compounds include a compound described in JP-A No. 63-212932.

The antifoggants and the stabilizers may be added at various times depending on the purpose, such as before grain formation, during grain formation, after grain formation, in the water washing step, at the time of dispersing after the water washing, before chemical sensitization, during chemical sensitization, after chemical sensitization, or before coating.

Besides exerting their original antifogging and stabilizing effects when added during the emulsion preparation, the antifoggants and the stabilizers may be used for multiple purposes such as controlling the crystal walls of the grains, reducing the grain size, reducing the solubility of the grains, regulating the chemical sensitization, and adjusting the dye arrangement.

In terms of exerting the effects of the present invention, it is preferable that the silver halide emulsion used in the present invention is spectrally sensitized with a methine dye or the like. Examples of the dye to be used include cyanine dyes, merocyanine dyes, complex cyanine dyes, complex merocyanine dyes, holopolar cyanine dyes, hemicyanine dyes, styryl dyes, and hemioxonol dyes.

Particularly useful dyes include dyes belonging to cyanine dyes, merocyanine dyes, and complex merocyanine dyes.

Any of basic heterocyclic nuclei that are usually used in cyanine dyes can be applied as the basic heterocyclic nuclei of these dyes. Examples of applicable nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, a nucleus obtained by fusion of an alicyclic hydrocarbon ring to any of the above nuclei, and a nuclei obtained by fusion of an aromatic hydrocarbon ring to any of the above nuclei, examples of which include an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may have a substituent on a carbon atom thereof.

A five-membered to six-membered heterocyclic nucleus, such as a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus, may be applied as a nuclei having a ketomethylene structure of the merocyanine dye or complex merocyanine dye.

The sensitizing dye may be used singly, or in combination thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, UK Patent Nos. 1,344,281 and 1,507,803, JP-B Nos. 43-4936 and 53-12375, and JP-A Nos. 52-110618 and 52-109925.

The emulsion may include, together with the sensitizing dye, a substance that shows supersensitization wherein the substance is a dye not having spectral sensitizing effect per se or a substance substantially not absorbing visible light.

The time when the sensitizing dye is added into the emulsion may be any stage of the emulsion preparation at which the addition is known to be effective. Most commonly, the addition is performed during a period after the completion of the chemical sensitization but before coating. However, the addition may be conducted at the same period as the addition of the chemical sensitizer so as to perform the spectral sensitization and the chemical sensitization simultaneously as described in U.S. Pat. Nos. 3,628,969 and 4,225,666, or may be conducted before the chemical sensitization as described in JP-A No. 58-113928, or may be conducted before completion of generation of silver halide grain precipitate so as to initiate the spectral sensitization.

Further, the compounds described above may be added in portions as described in U.S. Pat. No. 4,225,666; in other words, it is possible to add a part of these compounds prior to the chemical sensitization and add the remaining part after the chemical sensitization, wherein the addition may be performed at any time during the formation of silver halide grains and a typical method is described in U.S. Pat. No. 4,183,756.

[Layer Structure of Emulsion Layer]

The silver halide photographic photosensitive material of the present invention has at least one silver halide photosensitive layer on a support. The silver halide photographic photosensitive material of the present invention may have two or more silver halide photosensitive layers, in which case the at least four kinds of monodispersed silver halide grains of the present invention having mutually different average equivalent sphere diameters may respectively be included in any layer or layers as long as the objects of the present invention are achieved.

When two or more silver halide photosensitive layers are provided, the plural silver halide emulsion layers are preferably arranged in a manner in which two layers, which are a high-sensitivity emulsion layer and a low-sensitivity emulsion layer, are arranged on a support such that the sensitivity is sequentially decreased toward the support, as described in the specifications of German Patent No. 1,121,470 and UK Patent No. 923,045. The arrangement may alternatively be such that a low-sensitivity emulsion layer is disposed at a side farther from the support and a high-sensitivity emulsion layer is disposed at a side nearer to the support, as described in JP-A Nos. 57-112751, 62-200350, 62-206541, and 62-206543.

In the photosensitive material of the present invention, two or more kinds of emulsion that mutually differ in at least one characteristic selected from the grain size, grain size distribution, halogen composition, grain shape, or sensitivity of the silver halide photosensitive emulsion may be mixed and used in the same layer.

A non-photosensitive layer may be provided as at least one of the following: a protective layer provided on the silver halide photosensitive layer; a layer disposed between the support and the silver halide photosensitive layer; or, when there are two or more silver halide photosensitive layers, an intermediate layer disposed between the silver halide photosensitive layers. These layers may include various additives.

For example, a non-photosensitive layer provided between the support and the silver halide photosensitive layer may include a dye or pigment, and this layer may serve as an antihalation layer.

The protective layer may include a matte agent for providing minute irregularities on its surface. Inclusion of the matte agent in the protective layer is advantageous in preventing mutual adhesion of photographic photosensitive materials when the photographic photosensitive materials are superposed on one another and stored. The matte agent may be soluble in the processing liquid or insoluble in the processing liquid. It is preferable to use both of a processing-liquid-soluble matte agent and a processing-liquid-insoluble matte agent in combination. For example, polymethyl methacrylate, poly(methyl methacrylate/methacrylic acid=9/1 (molar ratio) or 5/5 (molar ratio)), polystyrene particles, and the like are preferable. The particle size is preferably from 0.8 μm to 10 μm, and the particle size distribution thereof is preferably narrower. It is preferable that 90% or more of the total number of the particles has particle sizes in the range of (0.9 times the average particle size) to (1.1 times the average particle size). In order to increase the matte property, it is preferable to simultaneously add fine particles of 0.8 μm or less, and examples thereof include polymethyl methacrylate (0.2 μm), poly(methyl methacrylate/methacrylic acid=9/1 (molar ratio)) (0.3 μm), polystyrene particles (0.25 μm), and colloidal silica (0.03 μm).

In the silver halide photographic photosensitive material of the present invention, the thickness between a surface of the support at a side at which the silver halide photosensitive layer is provided and a surface of the silver halide photographic photosensitive material (i.e., a surface of the silver halide photosensitive layer at a side opposite to the support side or, if the silver halide photographic photosensitive material has a protective layer, the surface of the protective layer) is 10 μm or less. The thickness is more preferably 8 μm or less, and most preferably 6 μm or less.

The silver halide photographic photosensitive material of the present invention preferably has a hydrophilic colloidal layer (referred to as back layer) having a total dry film thickness of 2 μm to 20 μm at the back side of the support, which is opposite to the side having the silver halide photosensitive layer.

The back layer preferably include an optical absorber, a filter dye, a UV absorber, an antistatic agent, a hardening agent, a binder, a plastisizer, a lubricant, a coating aid, and/or a surfactant.

[Support]

Appropriate supports that can be used in the present invention are described, for example, in the following: No. 17643, p. 28 of the above-mentioned *RD*; ibid. No. 18716, p. 647, right column to p. 648, left column; and ibid. No. 307105, p. 879. A particularly preferred support is a film of a polyester such as polyethylene terephthalate or polyethylene naphthalate.

The silver halide photographic photosensitive material of the present invention has excellent characteristics for digital archives that store digital data taken from the master movie film, as it is. The digital data is printed on the silver halide photographic photosensitive material of the present invention (imagewise exposure), which is then subjected to development and fixing treatment to form a film having a black-and-white image, and this film is stored.

As the developer to be used in the developer and fixing treatment, D97 or D96, the formulations of which are available from Eastman Kodak Company, may be used.

A stop treatment may be performed after development but before fixing treatment.

After the treatment with a fixer, washing with water is performed whereby the silver halide grains that have been converted to a soluble silver salt by the fixer are dissolved and removed from the silver halide photosensitive layer, thereby completing the fixing treatment.

The development treatment formulation and the fixing treatment formulation including D96 and D97 above are described in Processing KODAK Motion Picture Films, Module 15 Processing Black-and-White Films.

The silver halide photosensitive material of the present invention is a silver halide photographic photosensitive material including a support and at least one silver halide photosensitive layer on the support, wherein γ(D97), which is the contrast on a characteristic curve obtained as a result of three-minute development with D97 developer, fulfills the condition defined by the following Formula (1), and γ(D96), which is the contrast on a characteristic curve obtained as a result of eight-minute development with D96 developer, fulfills the condition defined by the following Formula (2).

$$0.6 \leqq \gamma(D97) \leqq 1.6 \quad (1)$$

$$0.6 \leqq \gamma(D96) \leqq 1.6 \quad (2)$$

The contrasts γ(D97) and γ(D96) mean values obtained as described below, and are defined as such.

Samples are exposed to light using a laser exposure apparatus ARRILASER manufactured by ARRI at varied exposure amounts, and are developed with D96 or D97. The obtained sensitometry images are measured for density by V (visual), and the gradient of the characteristic curve at the density at which the density value is the minimum density+1.0 is used as the contrast γ(D97) or γ(D96).

In the silver halide photosensitive material of the present invention, it is more preferred that the contrast γ(D97) described above fulfills the condition defined by Formula (1) above and the contrast γ(D96) fulfills the condition defined by Formula (2) above, and the ratio between contrasts γ(D97) and γ(D96) fulfills the following Formula (3).

$$0.8 \leqq \gamma(D97)/\gamma(D96) \leqq 1.39 \quad (3)$$

D96 treatment and D97 treatment are generally used for black-and-white treatment for movies. The D96 treatment is often used for development of black-and-white negative films, and the D97 treatment is often used for development of black-and-white positive films. The silver halide photographic photosensitive material of the present invention is a photosensitive material to be used in photofinishing laboratories, and is expected to be usable in both D96 treatment and D97 treatment in accordance with the circumstance in the individual photofinishing laboratories. The silver halide photographic photosensitive material of the invention is also expected to have stable characteristics against composition variation in the above treatments caused by running and/or inadequate control.

The inventors of the present invention have studied the conditions of various commercial developers, as a result of which the inventors have confirmed that silver halide photographic photosensitive materials satisfying the above Formula (3) are preferable for the objects.

According to the present invention, sufficient performance as a photosensitive material for archives is offered regardless of whether the D96 treatment or the D97 treatment is selected in accordance with the circumstance in the individual photofinishing laboratories. Moreover, stable performance can be offered even when the compositions used in the treatments are changed due to running or inadequate control.

The silver halide photographic photosensitive material of the present invention, exhibiting such characteristics, is excellent for digital archives of movie films since the developer dependency of the silver halide photographic photosensitive material is small and image deterioration during long term storage is also small.

The silver halide photographic photosensitive material of the present invention has the contrast γ(D96) and the contrast γ(D96), which preferably fulfill the conditions defined by the following Formulae (1a) and (2a) respectively, and more preferably fulfill the conditions defined by the following Formulae (1b) and (2b) respectively.

$$0.7 \leqq \gamma(D97) \leqq 1.4 \quad (1a)$$

$$0.7 \leqq \gamma(D96) \leqq 1.4 \quad (2a)$$

$$0.8 \leqq \gamma(D97) \leqq 1.3 \quad (1b)$$

$$0.8 \leqq \gamma(D96) \leqq 1.3 \quad (2b)$$

Further, in the silver halide photographic photosensitive material of the present invention, the ratio between the contrast γ(D96) and the contrast γ(D96) preferably satisfies the following Formula (3a), and more preferably satisfies the following Formula (3b).

$$0.85 \leqq \gamma(D97)/\gamma(D96) \leqq 1.25 \quad (3a)$$

$$0.9 \leqq \gamma(D97)/\gamma(D96) \leqq 1.2 \quad (3b)$$

Instruments that can be used for recording digital information on the silver halide photographic photosensitive material in the method of the present invention—so-called film recorders—are not particularly limited, and commercially available instruments may be used. Examples thereof include ARRILASER and ARRILASER HD manufactured by ARRI, which use BGR lasers as a light source system; FURY and FIRESTORM manufactured by CELCO Ltd., which use a CRT system as a light source system; IMAGICA REALTIME and HSR high-speed recorder manufactured by IMAGICA Corp., which use a LCOS system as a light source system; and CINEVATOR ONE and CINEVATOR FIVE manufactured by CINEVATION AS.

The present invention is described in more detail below with reference to Examples, which should not be construed as limiting the present invention.

EXAMPLE 1

(Preparation of Emulsion Em-A)

An AgBrI emulsion was prepared as described below. The following solutions A to E were used in the preparation.

<<Solution A>> An aqueous solution containing 30 g of lime-treated ossein gelatin, 0.4 g of KBr, and 1.3 L of water <<Solution B>> 0.2 L of aqueous solution containing 20 g of $AgNO_3$ <<Solution C>> 0.2 L of aqueous solution containing 15 g of KBr and 0.6 g of KI <<Solution D>> 0.65 L of aqueous solution containing 162.5 g of $AgNO_3$ <<Solution E>> 0.7 L aqueous solution containing 124.8 g of KBr, 5.4 g of KI, and 0.6 g of NaCl Solution A was put into a reaction vessel and maintained at 60° C. while stirring. 150 mL of solution B was added thereto over 5 minutes, during which solution C was added in a regulated addition amount so as to maintain the pBr in the reaction vessel at 3.5. After completion of the addition, the solution in the reaction vessel was heated to 70° C. Subsequently, 540 mL of solution D was added thereto over 15 minutes, during which solution E was added in a regulated addition amount so as to maintain the pBr in the reaction vessel at 3.5. During the addition, 0.005 g of thiourea dioxide, 0.005 g of sodium benzene sulfonate, and 0.0003 g of $K_2IrCl_6$ were added into the reaction vessel.

After completion of the addition, desalting step was performed according to a flocculation method. After completion of the desalting step, the following chemical sensitization treatment and spectral sensitization treatment were conducted. The emulsion after completion of the desalting was maintained at 60° C., and sensitizing dyes ExS-4, ExS-5, ExS-6, ExS-7, potassium thiocyanate, chloroauric acid, sodium thiosulfate, N,N-dimethylselenourea, 4-hydroxy-6-methyl-1,3,3a,7-tetraazaindene (TAI), compound 1, compound 2, and compound 3 were added to perform optimized spectral sensitization and chemical sensitization. The sensitizing dyes were added in optimal amounts by appropriately adjusting the dye ratio. The obtained grains were cubic grains having an average equivalent sphere diameter of 0.18 μm and a variation coefficient of 11%.

The average equivalent sphere diameter and variation coefficient of the obtained grains were determined as follows. Transmission electron micrograph was taken by a direct method, and the diameter of a sphere having the same area as the projection area of each grain (equivalent sphere diameter) was obtained. Randomly-selected 500 grains were observed for each emulsion. The average equivalent sphere diameter and the variation coefficient were determined from the grain size distribution obtained as described above.

ExS-4

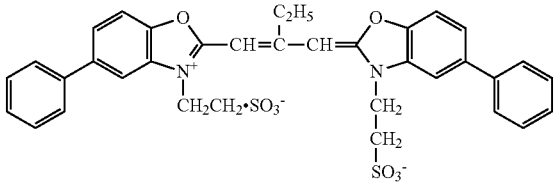

-continued

ExS-5

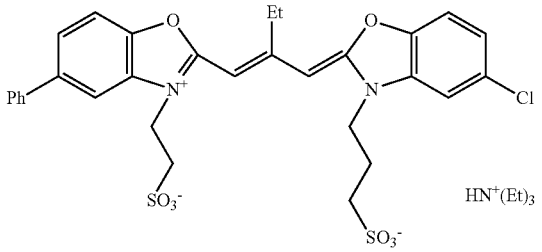

ExS-6

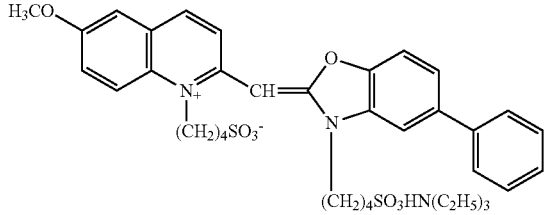

ExS-7

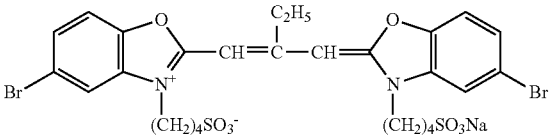

Compound 1

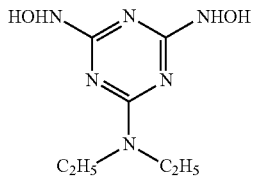

Compound 2

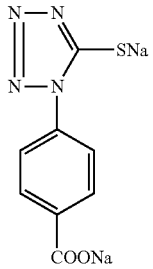

Compound 3

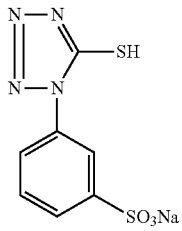

(Preparation of Emulsions Em-F, G, H, I, J, K, L, M and N)

Emulsions Em-F, G, H, I, J, K, L, M and N were prepared in the same manner as emulsion Em-A, except that the temperature of the solution in the reaction vessel, the compositions and concentrations of solutions A to E, the addition rates of solutions B to E, the pBr of the solution in the reaction vessel, the addition amounts of thiourea dioxide, sodium benzene sulfonate, and $K_2IrCl_6$, the sensitizing dyes used after completion of the desalting, and the chemical sensitization in the preparation of emulsion Em-A were changed emulsion by emulsion. In Em-L, the sensitizing dyes and the chemical sensitization were controlled to offer the same sensitivity as that of Em-D.

(Preparation of Em-B)

An AgBrI monodispersed cubic emulsion was prepared as described below. Solutions A' to C' used in the preparation were as described below.

<<Solution A'>> An aqueous solution containing 30 g of lime-treated ossein gelatin, 0.4 g of KBr, and 1.5 L of water <<Solution B'>> 0.65 L of aqueous solution containing 162.5 g of $AgNO_3$ <<Solution C'>> 0.7 L of aqueous solution containing 125.4 g of KBr, 4.5 g of KI, and 0.3 g of NaCl Solution A' was put into a reaction vessel and maintained at 55° C. while stirring. 540 mL of solution B' was added over 10 minutes, during which solution C' was added in a regulated addition amount so as to maintain the pBr of the reaction vessel at 3.5. During the addition, 0.007 g of thiourea dioxide, 0.007 g of sodium benzene sulfonate, and 0.0005 g of $K_2IrCl_6$ were also added into the reaction vessel.

After completion of the addition, desalting step was performed according to a flocculation method. After completion of the desalting step, the following chemical sensitization treatment and spectral sensitization treatment were conducted. The emulsion after the desalting was maintained at 62° C., and the above-mentioned sensitizing dyes ExS-4, ExS-5, ExS-6, ExS-7, chloroauric acid, sodium thiosulfate, 4-hydroxy-6-methyl-1,3,3a,7-tetraazaindene (TAI), the above-mentioned compound 1, compound 2, and compound 3 were added to perform optimized spectral sensitization and chemical sensitization. The sensitizing dyes were added in optimum amounts by appropriately adjusting the dye ratio. The obtained grains were cubic grains having an average equivalent sphere diameter of 0.10 μm and a variation coefficient of 13%.

(Preparation of Emulsions Em-C, D, and E)

Emulsions Em-C, D, and E were prepared in the same manner as emulsion C above, except that the temperature of the solution in the reaction vessel, the compositions and concentrations of solutions A' to C', the addition rates of solutions B' and C', the pBr of the solution in the reaction vessel, the addition amounts of thiourea dioxide, sodium benzene sulfonate, and $K_2IrCl_6$, the sensitizing dyes used after completion of the desalting, and the chemical sensitization were changed emulsion by emulsion.

The grain shape, average equivalent sphere diameter, grain size variation coefficient, and silver iodide content of the silver halide grains of each of thus-prepared emulsions Em-A to Em-N are shown in Table 1.

TABLE 1

| Emulsion | Grain Shape | Grain Size | Variation Coefficient | I Content |
|---|---|---|---|---|
| Em-A | Cubic | 0.18 μm | 12% | 2.0 mol % |
| Em-B | Cubic | 0.10 μm | 13% | 2.0 mol % |
| Em-C | Cubic | 0.08 μm | 14% | 2.0 mol % |
| Em-D | Cubic | 0.07 μm | 14% | 2.0 mol % |
| Em-E | Cubic | 0.09 μm | 14% | 2.0 mol % |
| Em-F | Cubic | 0.35 μm | 17% | 2.0 mol % |
| Em-G | Cubic | 0.31 μm | 15% | 2.0 mol % |
| Em-H | Cubic | 0.28 μm | 14% | 2.0 mol % |
| Em-I | Cubic | 0.18 μm | 14% | 2.3 mol % |
| Em-J | Cubic | 0.18 μm | 15% | 3.0 mol % |
| Em-K | Cubic | 0.18 μm | 32% | 4.0 mol % |

TABLE 1-continued

| Emulsion | Grain Shape | Grain Size | Variation Coefficient | I Content |
|---|---|---|---|---|
| Em-L | Cubic | 0.10 μm | 13% | 2.0 mol % |
| Em-M | Cubic | 0.23 μm | 11% | 2.0 mol % |
| Em-N | Indefinite Shape | 0.18 μm | 42% | 6.3 mol % |

(Preparation of Photosensitive Material Sample 101)

A polyethylene terephthalate film support (120 μm in thickness) was prepared which had an undercoat layer on a surface to be coated with an emulsion and which was coated with an acrylic resin layer (back layer) containing the following electrically conductive polymer (0.05 g/m$^2$) and tin oxide fine particles (0.20 g/m$^2$) on a side opposite to the surface to be coated with the emulsion.

A silver halide photographic photosensitive material was produced by providing first to third layers having the following compositions in this order on the undercoat layer disposed on the support. This sample is referred to as sample 101.

The coating amounts of silver halide described below are amounts of silver expressed in g/m$^2$ unit, and the coating amounts of additives and gelatins described below are amounts thereof expressed in g/m$^2$ unit.

First Layer (Antihalation Layer):

| | |
|---|---|
| Gelatin | 1.500 |
| Solid disperse dye S-8 | 0.080 |
| Solid disperse dye S-10 | 0.030 |
| Sodium polystyrene sulfonate | 0.025 |
| Dye 1 | 0.040 |
| Dye 2 | 0.008 |
| Sodium dodecylbenzene sulfonate | 0.005 |
| Phosphoric acid | 0.012 |
| Antiseptic | 0.003 |

S-8

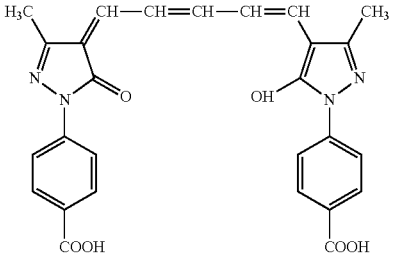

S-10

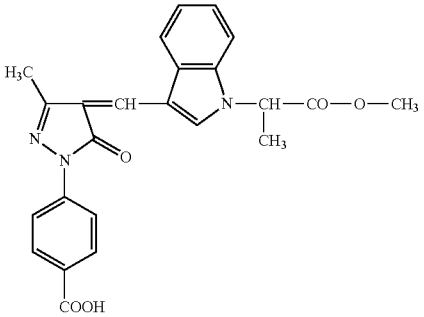

-continued

Dye 1

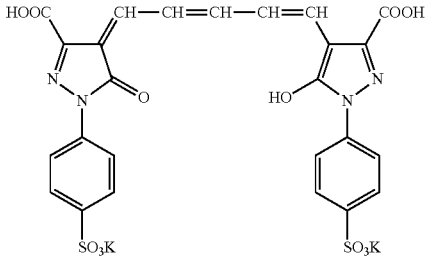

Dye 2

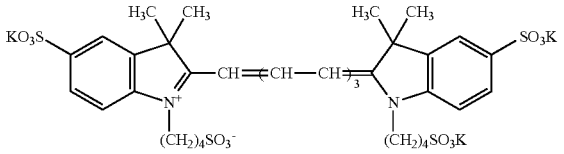

Second Layer (Silver Halide Photosensitive Layer):

The following four emulsions were mixed and used such that the coating amounts of silver of the respective emulsion became the values described below.

| | | |
|---|---|---|
| Emulsion Em-A | Silver coating amount | 0.425 |
| Emulsion Em-B | Silver coating amount | 0.425 |
| Emulsion Em-C | Silver coating amount | 0.425 |
| Emulsion Em-D | Silver coating amount | 0.425 |
| Gelatin | | 5.000 |
| Sodium polystyrene sulfonate | | 0.015 |
| Polyethyl acrylate latex | | 0.020 |
| 2,2-bis(vinylsulfonylacetamide)ethane | | 0.280 |

Third Layer (Protective Layer):

| | |
|---|---|
| Gelatin | 0.97 |
| Acrylic resin (having an average particle size of 2 μm) | 0.002 |
| Cpd-55 | 0.005 |
| Cpd-56 | 0.08 |
| Di-(2-ethylhexyl)sulfosuccinate sodium salt | 0.03 |

Cpd-55

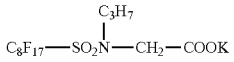

Cpd-56

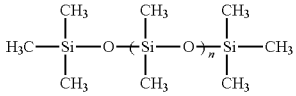

(Sample 102)

A silver halide photosensitive material was prepared in the same manner as sample 101 except that Em-A, Em-B, Em-C, and Em-D were removed from the second layer of sample 101 and replaced with emulsion Em-M in a silver coating amount of 2.0 g/m$^2$. The resultant material is referred to as sample 102.

(Sample 103)

A silver halide photographic photosensitive material was prepared in the same manner as sample 101 except that Em-A, Em-B, Em-C, and Em-D were removed from the second layer of the obtained sample 101 and replaced with Em-N in a silver coating amount of 3.2 g/m$^2$. The resultant material is referred to as sample 103.

(Sample 104)

A silver halide photographic photosensitive material was prepared in the same manner as sample 101 except that Em-B and Em-C were removed from the second layer of the obtained sample 101 and replaced with Em-E in a silver coating amount of 0.85 g/m$^2$. The resultant material is referred to as sample 104.

(Sample 105)

A silver halide photographic photosensitive material was prepared in the same manner as sample 101 except that Em-C and Em-D were removed from the second layer of the obtained sample 101 and replaced with Em-H and Em-M in silver coating amounts of 0.425 g/m$^2$, respectively. The resultant material is referred to as sample 105.

(Sample 106)

A silver halide photographic photosensitive material was prepared in the same manner as sample 101 except that Em-A, Em-B, Em-C, and Em-D were removed from the second layer of the obtained sample 101 and replaced with Em-F, Em-G, Em-H, and Em-M in silver coating amounts of 0.425 g/m$^2$, respectively. The resultant material is referred to as sample 106.

(Sample 107)

A silver halide photographic photosensitive material was prepared in the same manner as sample 101 except that Em-A was removed from the second layer of the obtained sample 101 and replaced with Em-I in a silver coating amount of 0.425 g/m$^2$. The resultant material is referred to as sample 107.

(Sample 108)

A silver halide photographic photosensitive material was prepared in the same manner as sample 101 except that Em-A was removed from the second layer of the obtained sample 101 and replaced with Em-J in a silver coating amount of 0.425 g/m$^2$. The resultant material is referred to as sample 108.

(Sample 109)

A silver halide photographic photosensitive material was prepared in the same manner as sample 101 except that Em-A was removed from the second layer of the obtained sample 101 and replaced with Em-K in a silver coating amount of 0.425 g/m$^2$. The resultant material is referred to as sample 109.

(Sample 110)

A silver halide photographic photosensitive material was prepared in the same manner as sample 105 except that each of the silver coating amounts in the second layer of the obtained sample 105 was changed to 0.25 g/m$^2$. The resultant material is referred to as sample 110.

(Sample 111)

A silver halide photographic photosensitive material was prepared in the same manner as sample 101 except that Em-C and Em-D were removed from the second layer of sample 101, Em-L was introduced, and the silver coating amount of each emulsion was changed to 0.57 g/m$^2$. The resultant material is referred to as sample 111.

<Evaluation>

(Gradation)

Samples were exposed to light using a laser exposure apparatus ARRILASER manufactured by ARRI. Two development treatments were conducted using D96 and D97, respectively, which are described in Processing KODAK Motion Picture Films, Module 15 Processing Black-and-White Films. The development time for D96 was 8 minutes, while the development time for D97 was 3 minutes. For evaluation of contrast, samples were exposed to a 21-level gray patch of ARRIaqua image, using an ARRILASERG laser, and then subjected to a development treatment, and then measured for density values of the 21-level gray patch by V (visual) to obtain a characteristic curve. The gradient at the density that is the minimum density+1.0 was determined from the characteristic curve. The V density value were measured by a X-rite.

(Calibration)

Further, calibration was performed using the measured density values and using Calros.aim as the target curve, and exposure to the ARRIaqua image and development thereof were conducted.

(Flare)

Films for screening (black-and-white positive film manufactured by Fujifilm Corporation) were produced from the obtained films by printing, and flare evaluation was performed by screening. The evaluation was performed by scoring on a scale of 1 to 5 on which 1 indicates a case in which flare was not observed at all, and 3 or less was tolerable level. Using this scale, functional evaluation by 20 people was performed, and an average score thereof was determined.

(Processing Property)

After the calibration, separate development treatments (treatments with D96) on the ARRI aqua image were conducted for a development time of 8', which is the standard development time, and 7' 30", respectively. The change in density when the 7' 30" treatment was performed after exposing at a light quantity, which offers Dmin+2.0 on the characteristic curve obtained by density measurement of the 21-level gray patch by the 8' treatment, was measured to determine process dependency.

The results of the above are shown in the following Tables 2-1 and 2-2.

TABLE 2-1

| | 101 | 102 | 103 | 104 | 105 |
|---|---|---|---|---|---|
| Silver Halide Grains | A 0.18<br>B 0.10<br>C 0.08<br>D 0.07 | M 0.23 | N 0.18 | A 0.18<br>E 0.09<br>D 0.07 | H 0.28<br>M 0.23<br>A 0.18<br>B 0.10 |
| Minimum Grain Size | 0.07 | 0.23 | 0.18 | 0.07 | 0.08 |
| Maximum Grain Size | 0.18 | 0.23 | 0.18 | 0.18 | 0.28 |
| Average Grain Size | 0.11 | 0.23 | 0.18 | 0.11 | 0.21 |
| Iodine Content | 2 | 2 | 6.3 | 2 | 2 |
| Variation Coefficient | 14 | 11 | 42 | 14 | 14 |
| Maximum Grain Silver Amount | 0.425 | 1.7 | 1.7 | 0.425 | 0.425 |
| Coating Amount of Silver | 1.7 | 2 | 3.2 | 1.7 | 1.7 |
| Emulsion Type | 4 | 1 | 1 | 3 | 4 |
| Film Thickness | 8 | 8 | 8 | 8 | 8 |
| γD96 | 1.1 | 2.5 | 0.9 | 1.4 | 1 |
| γD97 | 1.3 | 3 | 1.3 | 1.7 | 1.3 |
| D97/D96 | 1.18 | 1.20 | 1.44 | 1.21 | 1.30 |
| Calibration D96 | Possible | Impossible | Possible | Possible | Possible |
| Processing Property D96 | 0.01 | N/A | 0.07 | 0.04 | 0.02 |
| Flare | 1 | N/A | 5 | 4 | 2 |
| Remarks | Invention | Comparative Example | Comparative Example | Comparative Example | Invention |

TABLE 2-2

| | 106 | 107 | 108 | 110 | 111 |
|---|---|---|---|---|---|
| Silver Halide Grains | F 0.35<br>G 0.31<br>H 0.28<br>M 0.23 | I 0.18<br>B 0.10<br>C 0.08<br>D 0.07 | J 0.18<br>B 0.10<br>C 0.08<br>D 0.07 | H 0.28<br>M 0.23<br>A 0.18<br>B 0.10 | A 0.18<br>B 0.10<br>L 0.10 |
| Minimum Grain Size | 0.23 | 0.07 | 0.07 | 0.1 | 0.1 |
| Maximum Grain Size | 0.35 | 0.18 | 0.18 | 0.28 | 0.18 |
| Average Grain Size | 0.29 | 0.11 | 0.11 | 0.21 | 0.13 |
| Iodine Content | 2 | 2.3 | 3 | 2 | 2 |
| Variation Coefficient | 17 | 14 | 15 | 14 | 14 |
| Maximum Grain Silver Amount | 0.425 | 0.425 | 0.425 | 0.25 | 0.425 |
| Coating Amount of Silver | 1.7 | 1.7 | 1.7 | 1 | 1.7 |
| Emulsion Type | 4 | 4 | 4 | 4 | 3 |
| Film Thickness | 8 | 8 | 8 | 8 | 8 |
| γD96 | 1 | 0.9 | 0.8 | 0.6 | 1 |
| γD97 | 1.4 | 1.2 | 1.1 | 0.7 | 1.3 |
| D97/D96 | 1.40 | 1.33 | 1.38 | 1.17 | 1.30 |
| Calibration D96 | Possible | Possible | Possible | Possible | Possible |
| Processing Property D96 | 0.04 | 0.02 | 0.02 | 0.02 | 0.03 |
| Flare | 4 | 2 | 3 | 3 | 3 |
| Remarks | Comparative Example | Invention | Invention | Invention | Reference Example |

As is understood from the results shown in Tables 2-1 and 2-2, silver halide photographic photosensitive material sample 101 according to the present invention exhibited a γ(D97) of 1.3, a γ(D96) of 1.1, and a γ(D97)/γ(D96) of 1.18, which indicates suitable characteristics for digital archives. Similar conclusions may apply to samples 105, 107, 108, and 110 according to the present invention. In contrast, sample 102 exhibited γ(d97) f 3.0 and γ(D96) of 2.5, and calibration was impossible. In the case of sample 103, γ(D97) was 1.3, γ(D96) was 0.9; however, γ(D97)/γ(D96) was 1.44, indicating excessively high processing liquid dependency and deterioration in flare. Therefore, sample 103 is unsuitable for digital archives. In the case of sample 104, γ(D97) was 1.7 and γ(D96) was 1.4, and the excessively high y values and deterioration in flare make it unsuitable for digital archives. In the case of sample 106, γ(D97)/γ(D96) was 1.4, which indicates high processing liquid dependency and deterioration in flare.

It should be naturally understood that the scope of the silver halide photographic photosensitive material according to the present invention is not limited to the above-mentioned embodiments, and various configurations may be adopted without departing from the gist of the present invention.

All publications, patent applications, and technical standards mentioned in this specification are herein incorporated by reference to the same extent as if each individual publication, patent application, or technical standard was specifically and individually indicated to be incorporated by reference.

The invention claimed is:

1. A method of forming a black-and-white image, comprising:

providing a silver halide photographic photosensitive material comprising a support and at least one silver halide photosensitive layer provided on the support, subjecting the silver halide photographic photosensitive material to imagewise exposure, and subjecting the silver halide photographic photosensitive material to a development and fixing treatment to form a black-and-white image thereon; wherein the at least one silver halide photosensitive layer comprises silver halide grains, the average equivalent sphere diameter of the silver halide grains contained in the at least one silver halide photosensitive layer is 0.30 μm or less, the silver halide photosensitive layer comprises four or more silver halide emulsions having mutually different average equivalent sphere diameters, and the thickness between a surface of the support at a side at which the silver halide photosensitive layer is provided and a surface of the silver halide photosensitive layer at a side opposite to the support is 10 μm or less.

2. The method of claim 1, wherein the average equivalent sphere diameter of the silver halide grains of the silver halide photosensitive layer is 0.20 μm or less.

3. The method of claim 1, wherein each of the four silver halide emulsions is monodispersed silver halide grains.

4. The method of claim 3, wherein, among the four monodispersed silver halide emulsions, the average equivalent sphere diameter D1 of monodispersed silver halide emulsions having the smallest average equivalent sphere diameter is 0.05 μm≦D1≦0.10 μm, and the average equivalent sphere diameter D2 of monodispersed silver halide emulsions having the greatest average equivalent sphere diameter is 0.15 μm≦D2≦0.30 μm.

5. The method of claim 4, wherein the content ratio of the monodispersed silver halide emulsion having the greatest average equivalent sphere diameter is from 20% to 30% in terms of silver weight, with respect to the silver weight of all silver halide grains included in the silver halide photosensitive layer.

6. The method of claim 1, wherein the silver amount of all of the at least one silver halide photosensitive layer is 3.5 $g/m^2$ or less.

7. The method of claim 3, wherein the iodine contents of the four monodispersed silver halide emulsions having mutually different average equivalent sphere diameters are each 2.5 mol % or less.

8. The method of claim 3, wherein the iodine contents of the four monodispersed silver halide emulsions having mutually different average equivalent sphere diameters are each 2.2 mol % or less.

9. The method of claim 1, wherein γ(D97), which is a contrast on a characteristic curve obtained as a result of three-minute development with D97 developer, fulfills the condition defined by the following Formula (1), and γ(D96), which is a contrast on a characteristic curve obtained as a result of eight-minute development with D96 developer, fulfills the condition defined by the following Formula (2):

$$0.6 \leqq \gamma(D97) \leqq 1.6 \quad \text{Formula (1)}$$

$$0.6 \leqq \gamma(D96) \leqq 1.6 \quad \text{Formula (2).}$$

10. The method of claim 9, wherein the contrast γ(D97) and the contrast γ(D96) fulfill conditions defined by the following Formulae (1a) and (2a) respectively:

$$0.7 \leqq \gamma(D97) \leqq 1.4 \quad \text{Formula (1a)}$$

$$0.7 \leqq \gamma(D96) \leqq 1.4 \quad \text{Formula (2a).}$$

11. The method of claim 9, wherein a ratio between the contrast γ(D97) and the contrast γ(D96) fulfills a condition defined by the following Formula (3):

$$0.8 \leqq \gamma(D97)/\gamma(D96) \leqq 1.39 \quad \text{Formula (3).}$$

12. The method of claim 3, wherein the at least four monodispersed silver halide emulsions are included in one silver halide photosensitive layer.

13. The method of claim 1, wherein the silver halide grains included in each of the at least four silver halide emulsions have a cubic crystal shapes.

14. The method of claim 1, wherein the average equivalent sphere diameter of each of the four silver halide emulsions is 0.30 μm or less.

15. The method of claim 1, wherein the average equivalent sphere diameter of all silver halide grains contained in the at least one silver halide photosensitive layer is 0.25 μm or less.

16. The method of claim 1, wherein a total silver amount of the silver halide grains contained in all silver halide photosensitive layers, if any, is in the range of from 1.0 $g/m^2$ to 2.0 $g/m^2$.

17. The method of claim 1, wherein the silver halide photographic photosensitive material comprises a protective layer, and the thickness between a surface of the support at a side at which the silver halide photosensitive layer is provided and a surface of the protective layer at a side opposite to the support side is 10 μm or less.

18. The method of claim 1, wherein the at least one silver halide photosensitive layer is one silver halide photosensitive layer.

19. The method of claim 1, wherein each of the four or more-silver halide emulsions is a negative working silver halide emulsion.

* * * * *